US012486733B1

(12) United States Patent
Valero et al.

(10) Patent No.: US 12,486,733 B1
(45) Date of Patent: Dec. 2, 2025

(54) SYSTEMS AND METHODS FOR SURFACE SUPERVISION OF A DOWNHOLE TOOL

(71) Applicant: Schlumberger Technology Corporation, Sugar Land, TX (US)

(72) Inventors: Henri-Pierre Valero, Paris (FR); Catrina De Matos, Abbeville (FR); Pierre-Yves Corre, Abbeville (FR); Ashers Partouche, Sugar Land, TX (US); Magdy Samir Osman, Bucharest (RO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/679,530

(22) Filed: May 31, 2024

(51) Int. Cl.
*E21B 33/124* (2006.01)
*E21B 43/267* (2006.01)

(52) U.S. Cl.
CPC ..... *E21B 33/1243* (2013.01); *E21B 43/267* (2013.01)

(58) Field of Classification Search
CPC .... E21B 33/124; E21B 33/1243; E21B 43/26; E21B 43/267; E21B 47/00; E21B 49/00
See application file for complete search history.

(56) References Cited

U.S. PATENT DOCUMENTS

| | | | | |
|---|---|---|---|---|
| 10,024,147 | B2 * | 7/2018 | Hamid | E21B 47/06 |
| 10,458,219 | B2 * | 10/2019 | Hazel | E21B 34/14 |
| 10,669,808 | B1 * | 6/2020 | Rosenholm | E21B 43/14 |
| 11,719,083 | B2 * | 8/2023 | Arshad | E21B 33/122 166/308.1 |
| 12,130,399 | B2 * | 10/2024 | Wheelock | G01V 1/46 |
| 12,241,332 | B1 * | 3/2025 | Ball | E21B 33/124 |

* cited by examiner

*Primary Examiner* — Kenneth L Thompson
(74) *Attorney, Agent, or Firm* — Jeffrey D. Frantz

(57) ABSTRACT

A device may expand a first packer against a borehole wall. A device may expand a second packer against the borehole wall. A device may expand a third packer against the borehole wall. A device may expand a fourth packer against the borehole wall. A device may pressurize an interior zone longitudinally between the second packer and the third packer to a first pressure relative to a hydrostatic borehole pressure that is greater than a second pressure of at least one exterior zone, wherein a first exterior zone is longitudinally between the first packer and the second packer and a second exterior zone is longitudinally between the third packer and fourth packer.

20 Claims, 4 Drawing Sheets

SYSTEMS AND METHODS FOR SURFACE SUPERVISION OF A DOWNHOLE TOOL

BACKGROUND

For drilling of a borehole, directional drilling allows creation of a non-linear borehole or a linear borehole through varying earth formations. Directional drilling units conventionally communicate with the surface to transmit status information and/or receive instructions through lengthy pulse communications. Reduction of communication time can increase the uptime of a drilling system.

SUMMARY

In some aspects, the techniques described herein relate to a method of providing fluid pressure in a downhole environment, the method including: expanding a first packer against a borehole wall; expanding a second packer against the borehole wall; expanding a third packer against the borehole wall; expanding a fourth packer against the borehole wall; and pressurizing an interior zone longitudinally between the second packer and the third packer to a first pressure relative to a hydrostatic borehole pressure that is greater than a second pressure of at least one exterior zone, wherein a first exterior zone is longitudinally between the first packer and the second packer and a second exterior zone is longitudinally between the third packer and fourth packer.

In some aspects, the techniques described herein relate to a downhole system including: a first packer configured to expand against a borehole wall to create a first packer seal; a second packer positioned in a first longitudinal direction from the first packer and configured to expand against a borehole wall to create a second packer seal; a third packer positioned in the first longitudinal direction from the second packer and configured to expand against a borehole wall to create a third packer seal; a fourth packer positioned in the first longitudinal direction from the third packer and configured to expand against a borehole wall to create a fourth packer seal; an interior fluid port configured to pressurize an interior zone longitudinally between the second packer and the third packer to a first pressure; and an exterior fluid port configured to pressurize an exterior zone longitudinally outside the second packer and the third packer to a second pressure different from the first. In some aspects, the downhole system comprises a fluid conduit having a longitudinal direction and the first, second, third and fourth packers are positions on the fluid conduit.

In some aspects, the techniques described herein relate to a downhole device including: a first packer; a second packer positioned in the longitudinal direction from the first packer; a third packer positioned in the longitudinal direction from the second packer; a fourth packer positioned in the longitudinal direction from the third packer; an interior port to an interior zone longitudinally between the second packer and the third packer configured to provide an interior pressurizing fluid to the interior zone; a first exterior port to a first exterior zone longitudinally between the first packer and the second packer configured to provide a first exterior pressurizing fluid different from the interior pressurizing fluid to the first exterior zone; and a second exterior port to a second exterior zone longitudinally between the third packer and the fourth packer configured to provide a second exterior pressurizing fluid different from the interior pressurizing fluid to the second exterior zone. In some aspects, the downhole system comprises a fluid conduit having a longitudinal direction and the first, second, third and fourth packers are positions on the fluid conduit.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which.

DETAILED DESCRIPTION

Embodiments of the present disclosure generally relate to devices, systems, and methods for providing a fluid in a downhole environment. More particularly, the present disclosure relates to the isolation (or partially isolation) of a longitudinal segment of a borehole into which a pressurized fluid is pumped to apply a fluid pressure to a surrounding formation or other material forming the borehole wall. In some embodiments, the pressurized fluid is used for hydraulic fracturing of the formation. In some embodiments, the pressurized fluid is used to test production of the formation. In some embodiments, the pressurized fluid is used to test an integrity of the borehole wall (such as that of a casing on the borehole).

In some embodiments, a device according to the present disclosure includes a longitudinal series of expandable packers that isolate (or at least partially isolate) adjacent zones from one another by limiting and/or preventing fluid flow between the zones. For example, the series of expandable packers create a series of packer seals against the borehole wall, limiting and/or preventing fluid flow between the zone through the borehole. In some embodiments, systems and methods described herein allow for fluid pressure of the pressurized fluid in at least one zone of the borehole to be greater than a maximum pressure differential across a single packer. For example, the packer seals may fail when a fluid pressure differential across the packer seal exceeds a maximum pressure differential of the seal. A series of packer seals that are pressurized to the maximum pressure differential can allow an interior zone to have a fluid pressure that is greater than the hydrostatic pressure in the borehole, and, therefore, the interior zone can apply a fluid pressure to the borehole wall and/or formation that is greater than with a conventional two-packer device.

Figure 1:
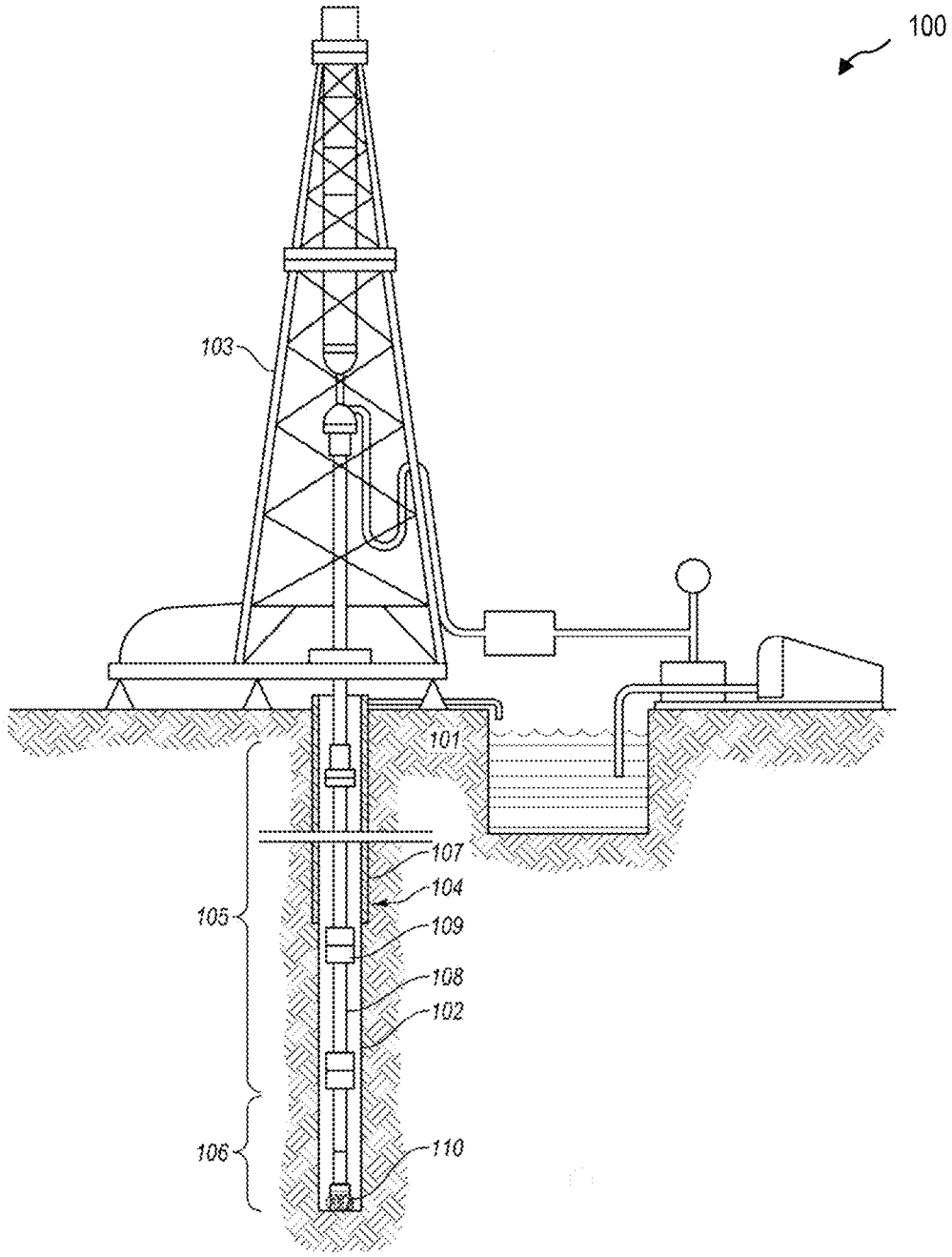
FIG. 1 illustrates a drilling system and downhole environment, according to some embodiments of the present disclosure.

FIG. 1 illustrates an embodiment of a drilling system and downhole environment. FIG. 1 shows one example of a drilling system 100 for drilling an earth formation 101 to form a borehole 102. The drilling system 100 includes a drill rig 103 used to turn a drilling assembly 104 which extends downward into the borehole 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the borehole 102 as it is being drilled, and for preventing the collapse of the borehole 102. The drilling fluid 111 carries drill solids including drill fines, drill cuttings, and other swarf from the borehole 102 to the surface based on a hydrostatic pressure of the borehole 102. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the borehole 102. The bit 110 may also be a junk mill used to mill away tools, plugs, cement, other materials within the borehole 102, or combinations thereof. Swarf or other cuttings formed by use of a mill may be lifted to surface by the drilling fluid 111 or may be allowed to fall downhole. The conditions of the equipment of the drilling system 100, the formation 101, the borehole 102, the drilling fluid 111, or other part of the wellsite can change during operations.

Figure 2:
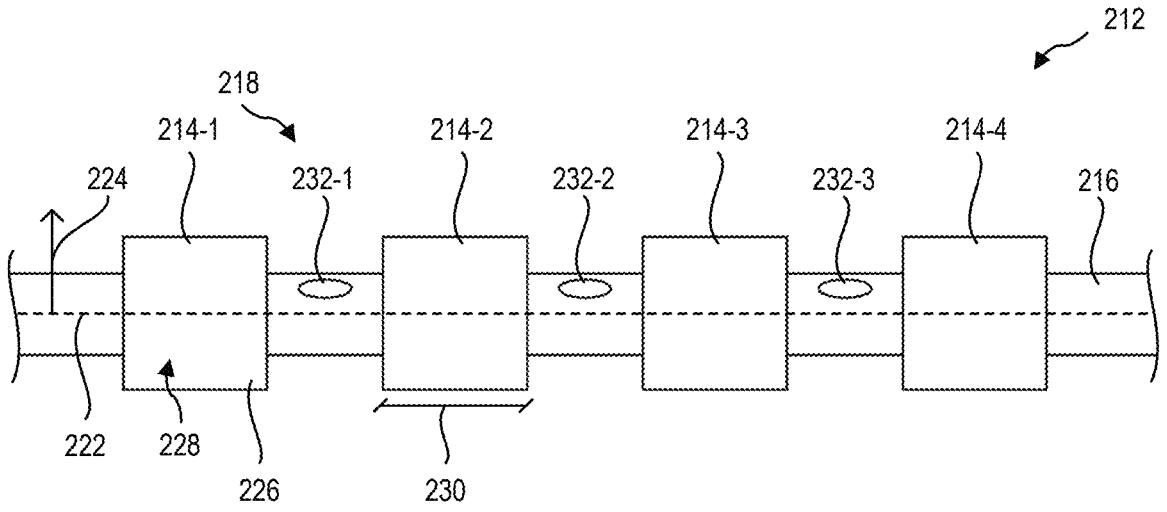
FIG. 2 is a side view of a device for pressuring a portion of a wellbore, according to some embodiments of the present disclosure.

FIG. 2 is a side view of a device 212 for pressuring a portion of a wellbore. In some embodiments, the device 212 includes a series of expandable packers 214 that are positioned on a fluid conduit 216. The expandable packers 214 are positioned with longitudinal spaces 218 between the packers 214 with fluid ports 220 in the longitudinal spaces 218 between the packers 214. In some embodiments, the device 212 includes at least four packers 214, such as the first packer 214-1, second packer 214-2, third packer 214-3, and fourth packer 214-4 positioned in a longitudinal series along a longitudinal direction 222 of the fluid conduit 216. While embodiments of systems and devices are described herein including four packers, it should be understood that other embodiments may include more, such as 6, 8, 10, or other even quantities of expandable packers in series.

In some embodiments, the expandable packers 214 have a retracted state and an expanded state. The retracted state has a width in a radial direction 224 (e.g., in a direction perpendicular to the longitudinal direction 222) that is less than the width of the expandable packer in the expanded state. In some embodiments, an expandable packer expands out toward the expanded state from the retracted state and contacts a wellbore wall, a liner, a casing, or other object substantially surrounding the expandable packer 214 in the radially outward direction. In some embodiments, the object prevents expansion of the expandable packer in the radially outward direction, and the expandable packer applies an expansive force to the object before reaching a stable width while contacting the object.

In some embodiments, at least one expandable packer 214 has a retracted width (e.g., in a retracted state) that is at least 50% of an expanded width (e.g., in an expanded state). In some embodiments, actuation of the expandable packer 214 ceases at some positioned between the retracted state and the expanded state when the expandable packer 214 is in contact with a surrounding object. In some embodiments, an expandable packer 214 is actuated toward the expanded state and continues attempting to expand while in contact with the object.

At least one expandable packer 214 of the device 212, in some embodiments, includes a resilient member 226 that is expanded outward in the radial direction 224. The expandable packer 214 is actuated between the retracted state and the expanded state by an actuation mechanism. In some embodiments, the resilient member 226 is expanded an actuation mechanism that introduced an expansion fluid 228 into the resilient member 226. In some embodiments, the expandable packer 214 includes a resilient member 226 that is urged outward by a mechanical actuation mechanism. For example, one or more hydraulic pistons may be actuated (i.e., through one or more valves) to expand the resilient member 226 outward. In some examples, an electric motor may expand at least a portion of the packer 214 outward. In some embodiments, a radially outward surface of the expandable packer 214 lacks a resilient member and includes a plurality of rigid segments that allow outward expansion.

In some embodiments, the expandable packers 214 (e.g., the first packer 214-1, second packer 214-2, third packer 214-3, and fourth packer 214-4) are substantially identical. For example, the expandable packers 214 may have one or more of the same retracted width, the same expanded width, the same longitudinal length 230, and the same actuation mechanism. In some embodiments, an interior pair of packers (e.g., the second packer 214-2 and the third packer 214-3) are substantially identical, and an exterior pair of packers (e.g., the first packer 214-1 and the fourth packer 214-4) are substantially identical. In some embodiments, the interior pair of packers is different from the exterior pair of packers. For example, the interior pair of packers may vary from the exterior pair of packers in at least one of the retracted width, the expanded width, the longitudinal length 230, and the actuation mechanism.

In some embodiments, the device 212 includes fluid ports 232 to provide a pressurizing fluid to the longitudinal spaces 218 between the packers 214. In some embodiments, the device 212 includes at least one fluid port 232 between each adjacent pair of packers 214. For example, a first fluid port 232-1 may be positioned longitudinally between the first packer 214-1 and the second packer 214-2. A second fluid port 232-2 may be positioned longitudinally between the second packer 214-2 and the third packer 214-3. A third fluid port 232-3 may be positioned longitudinally between the third packer 214-3 and the fourth packer 214-3.

In some embodiments, the first fluid port 232-1 (positioned between the first packer 214-1 and the second packer 214-2) and third fluid port 232-3 (positioned between the third packer 214-3 and the fourth packer 214-3) are exterior fluid ports, while the second fluid port 232-2 (positioned between the second packer 214-2 and the third packer 214-3) is an interior fluid port. For example, the first fluid port 232-1 may be a first exterior port, the second fluid port 232-2 may be an interior fluid port, and the third fluid port 232-3 may be a second exterior port. While the fluid ports are configured to provide a pressurizing fluid between the packers, in some embodiments, the interior fluid port and the exterior fluid ports are configured to provide different pressurizing fluids. For example, the interior fluid port may provide a first pressurizing fluid including a proppant suspended therein, while the exterior fluid ports provide a second pressurizing fluid lacking a proppant. In some embodiments, the interior fluid port and the exterior fluid port are configured to provide the same pressurizing fluid.

In some embodiments, the interior fluid port and the exterior fluid port are configured to provide the pressurizing fluid (or fluids) at different fluid pressures. In some embodiments, the interior fluid port and the exterior fluid port are configured to provide the pressurizing fluid (or fluids) at substantially the same fluid pressures.

In some embodiments, one or more of the pressurizing fluids is the same as an expansion fluid 228 used to expand one or more of the packers 214. In some embodiments, one or more of the pressurizing fluids and the expansion fluid(s) are different from one another.

In some embodiments, the fluid conduit 216 is a segment of a drill string, such as the drill string 105 described in relation to FIG. 1. In some embodiments, the fluid conduit 216 is separate from a drill string. In some embodiments, a pressurizing fluid is a drilling fluid, such as the drilling fluid 111 described in relation to FIG. 1. In some embodiments, the pressurizing fluid is a different fluid. In some embodiments, the pressurizing fluid is a clean fluid that is transported downhole in the device and/or in the drill string. For example, the clean fluid may be water, glycerin, or another liquid fluid. In some examples, the clean fluid is carbon dioxide or another gaseous fluid.

While some embodiments illustrated and described herein include the pressurizing device 212 and/or components of the pressurizing device 212 connected to a fluid conduit, it should be understood that at least some components of the pressurizing device 212 may be delivered downhole via wireline. In such embodiments, the packers 214 may be connected by a body of the device that is not a fluid conduit but may contain one or more conduits therein to deliver fluid to the ports 232 thereof. As described herein, the pressurizing device 212 may include a bottle or other container of clean fluid to expand the packers 214 and/or pressurize the zones between the packers 214. In such embodiments, the pressurizing device 212 is not part of a drill string (as described in relation to FIG. 1) and is inserted independently of a drill string.

In some embodiments, the device can isolate longitudinal zones of the wellbore and introduce a pressurizing fluid to those zones to test or fracture the wellbore wall, such as a liner or casing, or a portion of the surrounding formation. For example, the device can isolate longitudinal zones of the wellbore and introduce a pressurizing fluid to those zones to test or fracture the formation and measure one or more properties of the formation.

Figure 3:
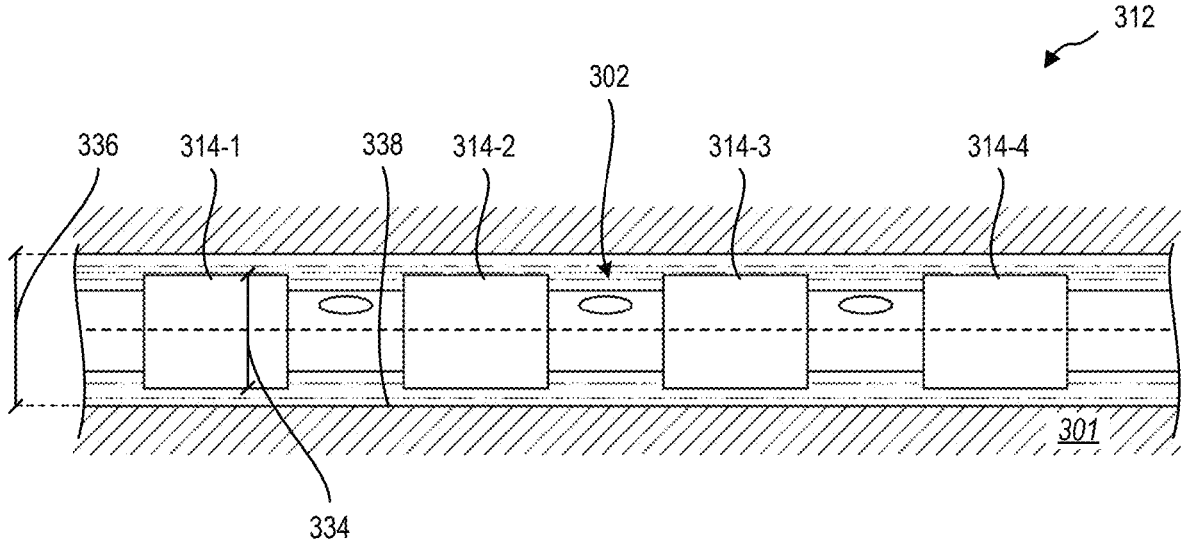
FIG. 3 is a side cross-sectional view of an embodiment of a pressurizing device in a wellbore, according to some embodiments of the present disclosure.

FIG. 3 is a side cross-sectional view of an embodiment of a pressurizing device 312 in a wellbore. In some embodiments, a pressurizing device 312 is tripped into a borehole 302 in a formation 301. In some embodiments, the borehole 302 includes a casing (such as described in relation to FIG. 1) or other material between the borehole 302 and the formation 301. The pressurizing device 312 is moved longitudinally through the borehole 302 to a location of the borehole 302 (or adjacent formation 301) to be pressurized. In some embodiments, the pressurizing device 312 is tripped downhole with the packers 314 in a retracted state. In some embodiments, one or more of the packers 314 is not in a retracted state. For example, one or more of the packers may be at least partially expanded with a width 334 of the packer 314 less than a diameter 336 of the borehole 302.

In some embodiments, the packers 314 are expanded simultaneously to contact the borehole wall 338 and form a packer seal between each of the expandable packers 314 and the borehole wall 338. In some embodiments, the packers 314 are expanded individually or with at least one of the packers 314 expanded separately from another packer 314. In some embodiments, the interior pair of packers (e.g., the second packer 314-2 and the third packer 314-3) is expanded simultaneously. In some embodiments, the exterior pair of packers (e.g., the first packer 314-1 and the fourth packer 314-4) is expanded simultaneously.

In some embodiments, the interior pair of packers is expanded against the borehole wall 338 before the exterior pair of packers is expanded against the borehole wall 388. For example, the interior pair of packers may define an interior zone in which the borehole wall 338 and/or formation 301 is to be tested, and expanding the interior pair of packers first may confirm the position of the pressurizing device 312 and/or allow simplified repositioning of the pressurizing device 312 before expanding the exterior pair of packers.

In some embodiments, the exterior pair of packers is expanded against the borehole wall 338 before the interior pair of packers is expanded against the borehole wall 388. For example, the interior pair of packers may define an interior zone in which the borehole wall 338 and/or formation 301 is to be tested, and expanding the exterior pair of packers first may secure the position of the pressurizing device 312 relative to borehole wall 338 before expanding the interior pair of packers to provide an improved packer seal between the interior pair of packers and the borehole wall 338.

In some embodiments, the packers 314 are expanded with an expansion fluid inside the packers 314. In some embodiments, the packers 314 are expanded to contact the borehole wall 338 and form a packer seal between each of the expandable packers 314 and the borehole wall 338 based on an internal pressure. For example, each packer 314 may be expanded with the same internal pressure. In some embodiments, at least one of the packers 314 is expanded at a different internal pressure from another packer 314. In some embodiments, the interior pair of packers (e.g., the second packer 314-2 and the third packer 314-3) is expanded to a first internal pressure, and the exterior pair of packers (e.g., the first packer 314-1 and the fourth packer 314-4) is expanded to a second internal pressure. In some embodiments, the first internal pressure is greater than the second internal pressure. In some embodiments, the first internal pressure is less than the second internal pressure.

In some embodiments, the packers 314 are expanded to contact the borehole wall 338 and form a packer seal between each of the expandable packers 314 and the borehole wall 338 with a contact pressure therebetween. For example, each packer 314 may be expanded to form a packer seal with the same contact pressure as the other packer seals. In some embodiments, at least one of the packers 314 is expanded to form a packer seal with a different contact pressure from another packer seal. In some embodiments, the interior pair of packers (e.g., the second packer 314-2 and the third packer 314-3) is expanded to produce interior packer seals with a first contact pressure, and the exterior pair of packers (e.g., the first packer 314-1 and the fourth packer 314-4) is expanded to produce exterior packer seals with a second contact pressure. In some embodiments, the first contact pressure is greater than the second contact pressure. In some embodiments, the first contact pressure is less than the second contact pressure.

Figure 4:
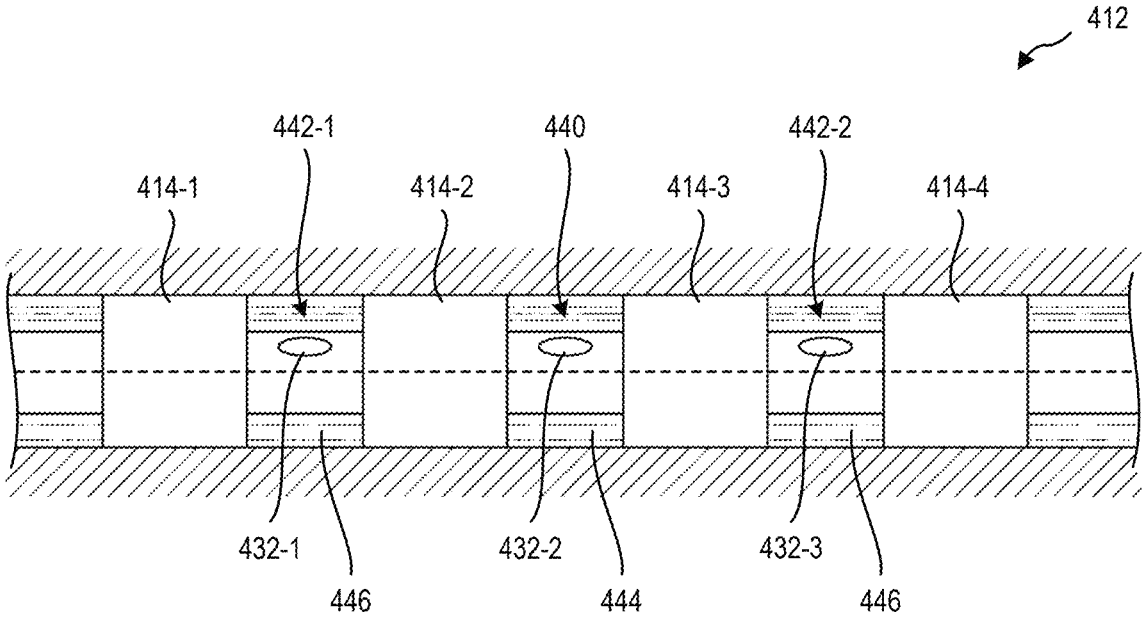
FIG. 4 is a side cross-sectional view of an embodiment of a pressurizing device in a wellbore with pressurized zones isolated by packers, according to some embodiments of the present disclosure.

After the packers 314 are expanded and the packer seals between the borehole wall 338 and the packers 314 are formed, a pressurizing fluid may be provided into the borehole 302. FIG. 4 is a side cross-sectional view of an embodiment of a pressurizing device 412 in a wellbore with pressurized zones isolated by packers 414. In some embodiments, the interior pair of packers (e.g., the second packer 414-2 and the third packer 414-3) define an interior zone 440 longitudinally therebetween. An interior fluid port (e.g., the second fluid port 432-2) is configured to provide a first pressurizing fluid 444 to the interior zone 440 to apply a fluid pressure to the formation or other borehole wall.

In some embodiments, the exterior pair of packers (e.g., the first packer 414-1 and the fourth packer 414-4) define exterior zones 442-1, 442-2 longitudinally adjacent to the interior zone 440. In some embodiments, exterior fluid ports (e.g., the first fluid port 432-1 and third fluid port 432-3) are configured to provide a second pressurizing fluid 446 to the exterior zones 442-1, 442-2 to apply a fluid pressure to the formation or other borehole wall and to the interior pair of packers. The fluid pressure in the first exterior zone 442-1 supports the second packer 414-2 against the fluid pressure in the interior zone 440, and the fluid pressure in the second exterior zone 442-2 supports the third packer 414-3 against the fluid pressure in the interior zone 440.

While the fluid ports 432 are configured to provide a pressurizing fluid 444, 446 between the packers 414, in some embodiments, the interior fluid port and the exterior fluid ports are configured to provide different pressurizing fluids. For example, the interior fluid port may provide a first pressurizing fluid 444 including a proppant suspended therein, while the exterior fluid ports provide a second pressurizing fluid 446 lacking a proppant. In some embodiments, the interior fluid port and the exterior fluid port are configured to provide the same pressurizing fluid.

In some embodiments, the pressurizing device 412 is configured to isolate the fluid pressures in the zones 440, 442-1, 442-2 between the packers 414 with the packer seals therebetween. Each packer seal may have a maximum pressure differential across the packer seal between zones. For example, the maximum pressure differential may be based at least partially on the contact pressure of the packer seal, the area of the packer seal, a material of the packer, a material or surface of the wellbore wall, or combinations thereof. In some embodiments, the maximum pressure differential across the interior packer seals (e.g., the packer seals of the interior pair of packers between the interior zone 440 and the exterior zones 442) is the same as the maximum pressure differential across the exterior packer seals (e.g., the packer seals of the exterior pair of packers between the exterior zones 442 and the hydrostatic pressure of the borehole). In some embodiments, the maximum pressure differential across the interior packer seals is greater than the maximum pressure differential across the exterior packer seals. In some embodiments, the maximum pressure differential across the interior packer seals is less than the maximum pressure differential across the exterior packer seals.

The longitudinal series of packer seals, in some embodiments, allows the interior zone 440 to apply a fluid pressure to the formation and/or wellbore wall (e.g., the hydrostatic pressure) that is greater than the maximum pressure differential across the interior packer seals. For example, the maximum pressure differential across the exterior packer seals may be 6 kilo-Pascals (kPa), and the maximum pressure differential across the interior packer seals may be 6 kPa. While a conventional packer system may be limited to applying a 6 kPa fluid pressure to the formation or wellbore wall, the serial configuration of the interior zone 440 between the exterior zones 442 allows the interior zone 440 to apply a 12 kPa pressure to the formation. For example, the exterior zones 442 may be each pressurized to 6 kPa above the hydrostatic pressure (e.g., the maximum pressure differential across the exterior packer seals), and the interior zone 440 may be pressurized to 6 kPa above the exterior zone fluid pressure (e.g., the maximum pressure differential across the interior packer seals). The resulting interior zone fluid pressure may be a total of 12 kPa greater than the hydrostatic pressure.

Figure 5:
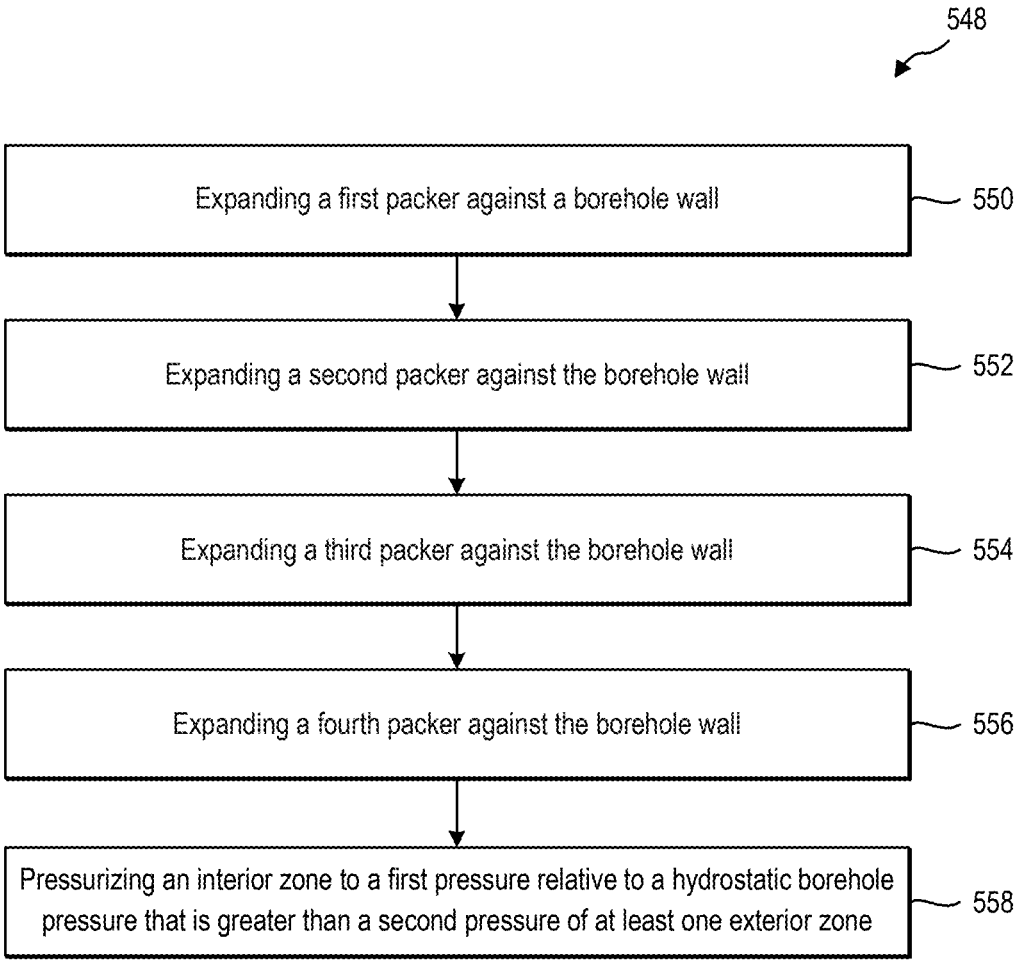
FIG. 5 is a flowchart illustrating an embodiment of a method of providing fluid pressure in a downhole environment, according to some embodiments of the present disclosure.

FIG. 5 is a flowchart illustrating an embodiment of a method 548 of providing fluid pressure in a downhole environment. The method 548 includes expanding a first packer against a borehole wall at 550, expanding a second packer against the borehole wall at 552, expanding a third packer against the borehole wall at 554, and expanding a fourth packer against the borehole wall at 556. Expanding the packers against the borehole wall creates a packer seal between each packer and the borehole wall. In some embodiments, the borehole wall is or includes the surrounding formation. In some embodiments, the borehole wall is or includes a wellbore liner or casing.

In some embodiments, expanding the packers 550, 552, 554, 556 includes expanding all of the packers simultaneously. In some embodiments, the packers are expanded individually or with at least one of the packers expanded separately from another packer. In some embodiments, the interior pair of packers (e.g., the second packer and the third packer) is expanded simultaneously. In some embodiments, the exterior pair of packers (e.g., the first packer and the fourth packer) is expanded simultaneously.

In some embodiments, the interior pair of packers is expanded against the borehole wall before the exterior pair of packers is expanded against the borehole wall. For example, the interior pair of packers may define an interior zone in which the borehole wall and/or formation is to be tested, and expanding the interior pair of packers first may confirm the position of the pressurizing device and/or allow simplified repositioning of the pressurizing device before expanding the exterior pair of packers.

In some embodiments, the exterior pair of packers is expanded against the borehole wall before the interior pair of packers is expanded against the borehole wall. For example, the interior pair of packers may define an interior zone in which the borehole wall and/or formation is to be tested, and expanding the exterior pair of packers first may secure the position of the pressurizing device relative to borehole wall before expanding the interior pair of packers to provide an improved packer seal between the interior pair of packers and the borehole wall.

In some embodiments, the packers are expanded with an expansion fluid inside the packers. In some embodiments, the packers are expanded to contact the borehole wall and form a packer seal between each of the expandable packers and the borehole wall based on an internal pressure. For example, each packer may be expanded with the same internal pressure. In some embodiments, at least one of the packers is expanded at a different internal pressure from another packer. In some embodiments, the interior pair of packers (e.g., the second packer and the third packer) is expanded to a first internal pressure, and the exterior pair of packers (e.g., the first packer and the fourth packer) is expanded to a second internal pressure. In some embodiments, the first internal pressure is greater than the second internal pressure. In some embodiments, the first internal pressure is less than the second internal pressure.

In some embodiments, the packers are expanded to contact the borehole wall and form a packer seal between each of the expandable packers and the borehole wall with a contact pressure therebetween. For example, each packer may be expanded to form a packer seal with the same contact pressure as the other packer seals. In some embodiments, at least one of the packers is expanded to form a packer seal with a different contact pressure from another packer seal. In some embodiments, the interior pair of packers (e.g., the second packer and the third packer) is expanded to produce interior packer seals with a first contact pressure, and the exterior pair of packers (e.g., the first packer and the fourth packer) is expanded to produce exterior packer seals with a second contact pressure. In some embodiments, the first contact pressure is greater than the second contact pressure. In some embodiments, the first contact pressure is less than the second contact pressure.

The method 548 further includes pressurizing an interior zone longitudinally between the second packer and the third packer to a first pressure (e.g., an interior fluid pressure) relative to a hydrostatic borehole pressure that is greater than a second pressure (e.g., an exterior fluid pressure) of at least one exterior zone at 558. In some embodiments, a first exterior zone is longitudinally between the first packer and the second packer. In some embodiments, a second exterior zone is longitudinally between the third packer and the fourth packer. In some embodiments, the method 548 includes further pressurizing the at least one exterior zone to the second pressure, where the second pressure is greater than the hydrostatic pressure of the borehole. In some embodiments, the first pressure is greater than the second pressure relative to the hydrostatic pressure of the borehole.

In some embodiments, a first pressurizing fluid provided to the interior zone and a second pressurizing fluid provided to the at least one exterior zone are the same fluid. For example, the pressurizing fluid may be a drilling fluid. In some embodiments, the first pressurizing fluid provided to the interior zone and the second pressurizing fluid provided to the at least one exterior zone are different fluids. For example, the first pressurizing fluid may be a hydraulic fracturing fluid, which may include a proppant, and the second pressurizing fluid may be another fluid, such as a drilling fluid.

In some embodiments, each of the packer seals has a maximum pressure differential before the packer seal fails and allows fluid flow across the packer in the wellbore. In some embodiments, the first pressure relative to the second pressure is less than a maximum pressure differential of a packer seal therebetween (e.g., the packer seal of the second packer between the interior zone and the first exterior zone) and the first pressure relative to the hydrostatic pressure of the borehole is greater than the maximum pressure differential of a packer seal between the first pressure and the second pressure. In some embodiments, the first pressure relative to the second pressure is less than a maximum pressure differential of a packer seal therebetween (e.g., the packer seal of the second packer between the interior zone and the first exterior zone) and the first pressure relative to the hydrostatic pressure of the borehole is greater than the maximum pressure differential across any packer seal of the pressuring device.

In some embodiments, an exterior maximum pressure differential of the exterior packer seals (e.g., the first packer seal and the fourth packer seal) is greater than an interior maximum pressure differential of the interior packer seals (e.g., the second packer seal and the third packer seal). For example, leakage or failure of the interior packer seals may create an increase in the exterior fluid pressure, and a greater exterior maximum pressure differential of the exterior packer seals may allow the exterior packer seals to limit or prevent fluid flow thereacross in the event of a sudden increase in the exterior fluid pressure relative to the hydrostatic borehole pressure. In some embodiments, an exterior maximum pressure differential of the exterior packer seals (e.g., the first packer seal and the fourth packer seal) is less than an interior maximum pressure differential of the interior packer seals (e.g., the second packer seal and the third packer seal). For example, the interior zone may be adjacent to the region of interest for the highest fluid pressure and pressurizing the interior zone to a proportionately higher fluid pressure than the exterior zone(s) may require less pressurizing fluid and therefore less pressurization time. The shorter pressurization time may allow more higher pressure testing and/or testing of more locations in the same total amount of time.

INDUSTRIAL APPLICABILITY

Embodiments of the present disclosure generally relate to devices, systems, and methods for providing a fluid to a downhole environment. More particularly, the present disclosure relates to the isolation (or partially isolation) of a longitudinal segment of a borehole into which a pressurized fluid is pumped to apply a fluid pressure to a surrounding formation or other material forming the borehole wall. In some embodiments, the pressurized fluid is used for hydraulic fracturing of the formation. In some embodiments, the pressurized fluid is used to test production of the formation. In some embodiments, the pressurized fluid is used to test an integrity of the borehole wall (such as that of a casing on the borehole).

In some embodiments, a device according to the present disclosure includes a longitudinal series of expandable packers that isolate (or at least partially isolate) adjacent zones from one another by limiting and/or preventing fluid flow between the zones. For example, the series of expandable packers create a series of packer seals against the borehole wall, limiting and/or preventing fluid flow between the zone through the borehole. In some embodiments, systems and methods described herein allow for fluid pressure of the pressurized fluid in at least one zone of the borehole to be greater than a maximum pressure differential across a single packer. For example, the packer seals may fail when a fluid pressure differential across the packer seal exceeds a maximum pressure differential of the seal. A series of packer seals that are pressurized to the maximum pressure differential can allow an interior zone to have a fluid pressure that is greater than the hydrostatic pressure in the borehole, and, therefore, the interior zone can apply a fluid pressure to the borehole wall and/or formation that is greater than with a conventional two-packer device.

In some embodiments, the pressurizing device includes a series of expandable packers that are positioned on a fluid conduit. The expandable packers are positioned with longitudinal spaces between the packers with fluid ports in the longitudinal spaces between the packers. In some embodiments, the device includes at least four packers, such as the first packer, second packer, third packer, and fourth packer positioned in a longitudinal series along a longitudinal direction of the fluid conduit. While embodiments of systems and devices are described herein including four packers, it should be understood that other embodiments may include more, such as 6, 8, 10, or other even quantities of expandable packers in series.

In some embodiments, the expandable packers have a retracted state and an expanded state. The retracted state has a width in a radial direction (e.g., in a direction perpendicular to the longitudinal direction) that is less than the width of the expandable packer in the expanded state. In some embodiments, an expandable packer expands out toward the expanded state from the retracted state and contacts a wellbore wall, a liner, a casing, or other object substantially surrounding the expandable packer in the radially outward direction. In some embodiments, the object prevents expansion of the expandable packer in the radially outward direction, and the expandable packer applies an expansive force to the object before reaching a stable width while contacting the object.

In some embodiments, at least one expandable packer has a retracted width (e.g., in a retracted state) that is at least 50% of an expanded width (e.g., in an expanded state). In some embodiments, actuation of the expandable packer ceases at some positioned between the retracted state and the expanded state when the expandable packer is in contact with a surrounding object. In some embodiments, an expandable packer is actuated toward the expanded state and continues attempting to expand while in contact with the object.

At least one expandable packer of the device, in some embodiments, includes a resilient member that is expanded outward in the radial direction. The expandable packer is actuated between the retracted state and the expanded state by an actuation mechanism. In some embodiments, the resilient member is expanded an actuation mechanism that introduced an expansion fluid into the resilient member. In some embodiments, the expandable packer includes a resilient member that is urged outward by a mechanical actuation mechanism. For example, one or more hydraulic pistons may be actuated (i.e., through one or more valves) to expand the resilient member outward. In some examples, an electric motor may expand at least a portion of the packer outward. In some embodiments, a radially outward surface of the expandable packer lacks a resilient member and includes a plurality of rigid segments that allow outward expansion.

In some embodiments, the expandable packers are substantially identical. For example, the expandable packers may have one or more of the same retracted width, the same expanded width, the same longitudinal length, and the same actuation mechanism. In some embodiments, an interior pair of packers (e.g., the second packer and the third packer) are substantially identical, and an exterior pair of packers (e.g., the first packer and the fourth packer) are substantially identical. In some embodiments, the interior pair of packers is different from the exterior pair of packers. For example, the interior pair of packers may vary from the exterior pair of packers in at least one of the retracted width, the expanded width, the longitudinal length, and the actuation mechanism.

In some embodiments, the device includes fluid ports to provide a pressurizing fluid to the longitudinal spaces between the packers. In some embodiments, the device includes at least one fluid port between each adjacent pair of packers. For example, a first fluid port may be positioned longitudinally between the first packer and the second packer. A second fluid port may be positioned longitudinally between the second packer and the third packer. A third fluid port may be positioned longitudinally between the third packer and the fourth packer.

In some embodiments, the first fluid port (positioned between the first packer and the second packer) and third fluid port (positioned between the third packer and the fourth packer) are exterior fluid ports, while the second fluid port (positioned between the second packer and the third packer) is an interior fluid port. For example, the first fluid port may be a first exterior port, the second fluid port may be an interior fluid port, and the third fluid port may be a second exterior port. While the fluid ports are configured to provide a pressurizing fluid between the packers, in some embodiments, the interior fluid port and the exterior fluid ports are configured to provide different pressurizing fluids. For example, the interior fluid port may provide a first pressurizing fluid including a proppant suspended therein, while the exterior fluid ports provide a second pressurizing fluid lacking a proppant. In some embodiments, the interior fluid port and the exterior fluid port are configured to provide the same pressurizing fluid.

In some embodiments, the interior fluid port and the exterior fluid port are configured to provide the pressurizing fluid (or fluids) at different fluid pressures. In some embodiments, the interior fluid port and the exterior fluid port are configured to provide the pressurizing fluid (or fluids) at substantially the same fluid pressures.

In some embodiments, one or more of the pressurizing fluids is the same as an expansion fluid used to expand one or more of the packers. In some embodiments, one or more of the pressurizing fluids and the expansion fluid(s) are different from one another.

In some embodiments, the fluid conduit is a segment of a drill string. In some embodiments, the fluid conduit is separate from a drill string. In some embodiments, a pressurizing fluid is a drilling fluid. In some embodiments, the pressurizing fluid is a different fluid. In some embodiments, the pressurizing fluid is a clean fluid that is transported downhole in the device and/or in the drill string. For example, the clean fluid may be water, glycerin, or another liquid fluid. In some examples, the clean fluid is carbon dioxide or another gaseous fluid.

While some embodiments illustrated and described herein include the pressurizing device and/or components of the pressurizing device connected to a fluid conduit, it should be understood that at least some components of the pressurizing device may be delivered downhole via wireline. In such embodiments, the packers may be connected by a body of the device that is not a fluid conduit but may contain one or more conduits therein to deliver fluid to the ports thereof. As described herein, the pressurizing device may include a bottle or other container of clean fluid to expand the packers and/or pressurize the zones between the packers. In such embodiments, the pressurizing device is not part of a drill string and is inserted independently of a drill string.

In some embodiments, the device can isolate longitudinal zones of the wellbore and introduce a pressurizing fluid to those zones to test or fracture the wellbore wall, such as a liner or casing, or a portion of the surrounding formation. For example, the device can isolate longitudinal zones of the wellbore and introduce a pressurizing fluid to those zones to test or fracture the formation and measure one or more properties of the formation.

In some embodiments, a pressurizing device is tripped into a borehole in a formation. In some embodiments, the borehole includes a casing or other material between the borehole and the formation. The pressurizing device is moved longitudinally through the borehole to a location of the borehole (or adjacent formation) to be pressurized. In some embodiments, the pressurizing device is tripped downhole with the packers in a retracted state. In some embodiments, one or more of the packers is not in a retracted state. For example, one or more of the packers may be at least partially expanded with a width of the packer less than a diameter of the borehole.

In some embodiments, the packers are expanded simultaneously to contact the borehole wall and form a packer seal between each of the expandable packers and the borehole wall. In some embodiments, the packers are expanded individually or with at least one of the packers expanded separately from another packer. In some embodiments, the interior pair of packers (e.g., the second packer and the third packer) is expanded simultaneously. In some embodiments, the exterior pair of packers (e.g., the first packer and the fourth packer) is expanded simultaneously.

In some embodiments, the interior pair of packers is expanded against the borehole wall before the exterior pair of packers is expanded against the borehole wall. For example, the interior pair of packers may define an interior zone in which the borehole wall and/or formation is to be tested, and expanding the interior pair of packers first may confirm the position of the pressurizing device and/or allow simplified repositioning of the pressurizing device before expanding the exterior pair of packers.

In some embodiments, the exterior pair of packers is expanded against the borehole wall before the interior pair of packers is expanded against the borehole wall. For example, the interior pair of packers may define an interior zone in which the borehole wall and/or formation is to be tested, and expanding the exterior pair of packers first may secure the position of the pressurizing device relative to borehole wall before expanding the interior pair of packers to provide an improved packer seal between the interior pair of packers and the borehole wall.

In some embodiments, the packers are expanded with an expansion fluid inside the packers. In some embodiments, the packers are expanded to contact the borehole wall and form a packer seal between each of the expandable packers and the borehole wall based on an internal pressure. For example, each packer may be expanded with the same internal pressure. In some embodiments, at least one of the packers is expanded at a different internal pressure from another packer. In some embodiments, the interior pair of packers (e.g., the second packer and the third packer) is expanded to a first internal pressure, and the exterior pair of packers (e.g., the first packer and the fourth packer) is expanded to a second internal pressure. In some embodiments, the first internal pressure is greater than the second internal pressure. In some embodiments, the first internal pressure is less than the second internal pressure.

In some embodiments, the packers are expanded to contact the borehole wall and form a packer seal between each of the expandable packers and the borehole wall with a contact pressure therebetween. For example, each packer may be expanded to form a packer seal with the same contact pressure as the other packer seals. In some embodiments, at least one of the packers is expanded to form a packer seal with a different contact pressure from another packer seal. In some embodiments, the interior pair of packers (e.g., the second packer and the third packer) is expanded to produce interior packer seals with a first contact pressure, and the exterior pair of packers (e.g., the first packer and the fourth packer) is expanded to produce exterior packer seals with a second contact pressure. In some embodiments, the first contact pressure is greater than the second contact pressure. In some embodiments, the first contact pressure is less than the second contact pressure.

After the packers are expanded and the packer seals between the borehole wall and the packers are formed, a pressurizing fluid may be provided into the borehole. In some embodiments, the interior pair of packers (e.g., the second packer and the third packer) define an interior zone longitudinally therebetween. An interior fluid port (e.g., the second fluid port) is configured to provide a first pressurizing fluid to the interior zone to apply a fluid pressure to the formation or other borehole wall.

In some embodiments, the exterior pair of packers (e.g., the first packer and the fourth packer) define exterior zones longitudinally adjacent to the interior zone. In some embodiments, exterior fluid ports (e.g., the first fluid port and third fluid port) are configured to provide a second pressurizing fluid to the exterior zones to apply a fluid pressure to the formation or other borehole wall and to the interior pair of packers. The fluid pressure in the first exterior zone supports the second packer against the fluid pressure in the interior zone, and the fluid pressure in the second exterior zone supports the third packer against the fluid pressure in the interior zone.

While the fluid ports are configured to provide a pressurizing fluid between the packers, in some embodiments, the interior fluid port and the exterior fluid ports are configured to provide different pressurizing fluids. For example, the interior fluid port may provide a first pressurizing fluid including a proppant suspended therein, while the exterior fluid ports provide a second pressurizing fluid lacking a proppant. In some embodiments, the interior fluid port and the exterior fluid port are configured to provide the same pressurizing fluid.

In some embodiments, the pressurizing device is configured to isolate the fluid pressures in the zones between the packers with the packer seals therebetween. Each packer seal may have a maximum pressure differential across the packer seal between zones. For example, the maximum pressure differential may be based at least partially on the contact pressure of the packer seal, the area of the packer seal, a material of the packer, a material or surface of the wellbore wall, or combinations thereof. In some embodiments, the maximum pressure differential across the interior packer seals (e.g., the packer seals of the interior pair of packers between the interior zone and the exterior zones) is the same as the maximum pressure differential across the exterior packer seals (e.g., the packer seals of the exterior pair of packers between the exterior zones and the hydrostatic pressure of the borehole). In some embodiments, the maximum pressure differential across the interior packer seals is greater than the maximum pressure differential across the exterior packer seals. In some embodiments, the maximum pressure differential across the interior packer seals is less than the maximum pressure differential across the exterior packer seals.

The longitudinal series of packer seals, in some embodiments, allows the interior zone to apply a fluid pressure to the formation and/or wellbore wall (e.g., the hydrostatic pressure) that is greater than the maximum pressure differential across the interior packer seals. For example, the maximum pressure differential across the exterior packer seals may be 6 kilo-Pascals (kPa), and the maximum pressure differential across the interior packer seals may be 6 kPa. While a conventional packer system may be limited to applying a 6 kPa fluid pressure to the formation or wellbore wall, the serial configuration of the interior zone between the exterior zones allows the interior zone to apply a 12 kPa pressure to the formation. For example, the exterior zones may be each pressurized to 6 kPa above the hydrostatic pressure (e.g., the maximum pressure differential across the exterior packer seals), and the interior zone may be pressurized to 6 kPa above the exterior zone fluid pressure (e.g., the maximum pressure differential across the interior packer seals). The resulting interior zone fluid pressure may be a total of 12 kPa greater than the hydrostatic pressure.

In some embodiments, a method of providing fluid pressure in a downhole environment includes expanding a first packer against a borehole wall, expanding a second packer against the borehole wall, expanding a third packer against the borehole wall, and expanding a fourth packer against the borehole wall. Expanding the packers against the borehole wall creates a packer seal between each packer and the borehole wall. In some embodiments, the borehole wall is or includes the surrounding formation. In some embodiments, the borehole wall is or includes a wellbore liner or casing.

In some embodiments, expanding the packers includes expanding all of the packers simultaneously. In some embodiments, the packers are expanded individually or with at least one of the packers expanded separately from another packer. In some embodiments, the interior pair of packers (e.g., the second packer and the third packer) is expanded simultaneously. In some embodiments, the exterior pair of packers (e.g., the first packer and the fourth packer) is expanded simultaneously.

In some embodiments, the interior pair of packers is expanded against the borehole wall before the exterior pair of packers is expanded against the borehole wall. For example, the interior pair of packers may define an interior zone in which the borehole wall and/or formation is to be tested, and expanding the interior pair of packers first may confirm the position of the pressurizing device and/or allow simplified repositioning of the pressurizing device before expanding the exterior pair of packers.

In some embodiments, the exterior pair of packers is expanded against the borehole wall before the interior pair of packers is expanded against the borehole wall. For example, the interior pair of packers may define an interior zone in which the borehole wall and/or formation is to be tested, and expanding the exterior pair of packers first may secure the position of the pressurizing device relative to borehole wall before expanding the interior pair of packers to provide an improved packer seal between the interior pair of packers and the borehole wall.

In some embodiments, the packers are expanded with an expansion fluid inside the packers. In some embodiments, the packers are expanded to contact the borehole wall and form a packer seal between each of the expandable packers and the borehole wall based on an internal pressure. For example, each packer may be expanded with the same internal pressure. In some embodiments, at least one of the packers is expanded at a different internal pressure from another packer. In some embodiments, the interior pair of packers (e.g., the second packer and the third packer) is expanded to a first internal pressure, and the exterior pair of packers (e.g., the first packer and the fourth packer) is expanded to a second internal pressure. In some embodiments, the first internal pressure is greater than the second internal pressure. In some embodiments, the first internal pressure is less than the second internal pressure.

In some embodiments, the packers are expanded to contact the borehole wall and form a packer seal between each of the expandable packers and the borehole wall with a contact pressure therebetween. For example, each packer may be expanded to form a packer seal with the same contact pressure as the other packer seals. In some embodiments, at least one of the packers is expanded to form a packer seal with a different contact pressure from another packer seal. In some embodiments, the interior pair of packers (e.g., the second packer and the third packer) is expanded to produce interior packer seals with a first contact pressure, and the exterior pair of packers (e.g., the first packer and the fourth packer) is expanded to produce exterior packer seals with a second contact pressure. In some embodiments, the first contact pressure is greater than the second contact pressure. In some embodiments, the first contact pressure is less than the second contact pressure.

The method further includes pressurizing an interior zone longitudinally between the second packer and the third packer to a first pressure (e.g., an interior fluid pressure) relative to a hydrostatic borehole pressure that is greater than a second pressure (e.g., an exterior fluid pressure) of at least one exterior zone. In some embodiments, a first exterior zone is longitudinally between the first packer and the second packer. In some embodiments, a second exterior zone is longitudinally between the third packer and the fourth packer. In some embodiments, the method includes further pressurizing the at least one exterior zone to the second pressure, where the second pressure is greater than the hydrostatic pressure of the borehole. In some embodiments, the first pressure is greater than the second pressure relative to the hydrostatic pressure of the borehole.

In some embodiments, a first pressurizing fluid provided to the interior zone and a second pressurizing fluid provided to the at least one exterior zone are the same fluid. For example, the pressurizing fluid may be a drilling fluid. In some embodiments, the first pressurizing fluid provided to the interior zone and the second pressurizing fluid provided to the at least one exterior zone are different fluids. For example, the first pressurizing fluid may be a hydraulic fracturing fluid, which may include a proppant, and the second pressurizing fluid may be another fluid, such as a drilling fluid.

In some embodiments, each of the packer seals has a maximum pressure differential before the packer seal fails and allows fluid flow across the packer in the wellbore. In some embodiments, the first pressure relative to the second pressure is less than a maximum pressure differential of a packer seal therebetween (e.g., the packer seal of the second packer between the interior zone and the first exterior zone) and the first pressure relative to the hydrostatic pressure of the borehole is greater than the maximum pressure differential of a packer seal between the first pressure and the second pressure. In some embodiments, the first pressure relative to the second pressure is less than a maximum pressure differential of a packer seal therebetween (e.g., the packer seal of the second packer between the interior zone and the first exterior zone) and the first pressure relative to the hydrostatic pressure of the borehole is greater than the maximum pressure differential across any packer seal of the pressuring device.

In some embodiments, an exterior maximum pressure differential of the exterior packer seals (e.g., the first packer seal and the fourth packer seal) is greater than an interior maximum pressure differential of the interior packer seals (e.g., the second packer seal and the third packer seal). For example, leakage or failure of the interior packer seals may create an increase in the exterior fluid pressure, and a greater exterior maximum pressure differential of the exterior packer seals may allow the exterior packer seals to limit or prevent fluid flow thereacross in the event of a sudden increase in the exterior fluid pressure relative to the hydrostatic borehole pressure. In some embodiments, an exterior maximum pressure differential of the exterior packer seals (e.g., the first packer seal and the fourth packer seal) is less than an interior maximum pressure differential of the interior packer seals (e.g., the second packer seal and the third packer seal). For example, the interior zone may be adjacent to the region of interest for the highest fluid pressure and pressurizing the interior zone to a proportionately higher fluid pressure than the exterior zone(s) may require less pressurizing fluid and therefore less pressurization time. The shorter pressurization time may allow more higher pressure testing and/or testing of more locations in the same total amount of time.

The present disclosure relates to systems and methods for providing fluid in a downhole environment according to any of the following:

Clause 1. A method of providing fluid pressure in a downhole environment, the method comprising: expanding a first packer against a borehole wall; expanding a second packer against the borehole wall; expanding a third packer against the borehole wall; expanding a fourth packer against the borehole wall; and pressurizing an interior zone longitudinally between the second packer and the third packer to a first pressure relative to a hydrostatic borehole pressure that is greater than a second pressure of at least one exterior zone, wherein a first exterior zone is longitudinally between the first packer and the second packer and a second exterior zone is longitudinally between the third packer and fourth packer.

Clause 2. The method of clause 1, further comprising pressurizing the first exterior zone and the second exterior zone to the second pressure, wherein the second pressure is greater than a hydrostatic pressure in the borehole.

Clause 3. The method of clause 1 or 2, wherein expanding the first packer against the borehole wall includes expanding the first packer to a first internal pressure and expanding the second packer against the borehole wall includes expanding the second packer to a second internal pressure different from the first internal pressure.

Clause 4. The method of clause 3, wherein expanding the third packer against the borehole wall includes expanding the third packer to the second internal pressure and expanding the fourth packer against the borehole wall includes expanding the fourth packer to the first internal pressure.

Clause 5. The method of clause 1 or 2, wherein expanding the first packer against the borehole wall includes expanding the first packer to a first contact pressure with the borehole wall and expanding the second packer against the borehole wall includes expanding the second packer to a second contact pressure with the borehole wall different from the first contact pressure.

Clause 6. The method of clause 5, wherein expanding the third packer against the borehole wall includes expanding the third packer to the second contact pressure with the borehole wall and expanding the fourth packer against the borehole wall includes expanding the fourth packer to the first contact pressure with the borehole wall.

Clause 7. The method of any preceding clause, wherein the first pressure relative to the hydrostatic borehole pressure is greater than a maximum pressure differential between the interior zone and at least one exterior zone after expanding the second packer and third packer against the borehole wall.

Clause 8. The method of any preceding clause, wherein the expanding the second packer and third packer includes creating interior packer seals with an interior maximum pressure differential thereacross, and the first pressure relative to the hydrostatic borehole pressure is greater than the interior maximum pressure differential.

Clause 9. The method of any preceding clause, wherein an interior pair of packers is expanded to contact the borehole wall before an exterior pair of packers.

Clause 10. The method of any preceding clause, wherein an exterior pair of packers is expanded to contact the borehole wall before an interior pair of packers.

Clause 11. The method of any preceding clause, wherein pressurizing the interior zone includes providing a first pressurized fluid to the interior zone that is different from a second pressurized fluid in the at least exterior zone.

Clause 12. The method of any preceding clause, wherein the first pressurized fluid includes a proppant suspended therein.

Clause 13. The method of any preceding clause, wherein the borehole wall includes a surrounding formation.

Clause 14. The method of any preceding clause, wherein the borehole wall includes a wellbore casing.

Clause 15. A downhole system comprising: a fluid conduit having a longitudinal direction; a first packer positioned on the fluid conduit and expanded against a borehole wall to create a first packer seal; a second packer positioned on the fluid conduit in a first longitudinal direction from the first packer and expanded against a borehole wall to create a second packer seal; a third packer positioned on the fluid conduit in the first longitudinal direction from the second packer and expanded against a borehole wall to create a third packer seal; a fourth packer positioned on the fluid conduit in the first longitudinal direction from the third packer and expanded against a borehole wall to create a fourth packer seal; an interior fluid port configured to pressurize an interior zone longitudinally between the second packer and the third packer to a first pressure; and an exterior fluid port configured to pressurize an exterior zone longitudinally outside the second packer and the third packer to a second pressure different from the first.

Clause 16. The downhole system of clause 15, wherein an interior maximum pressure differential across the second packer seal from the interior zone to the first exterior zone is greater than an exterior maximum pressure differential across the first packer seal from the first exterior zone to a hydrostatic borehole.

Clause 17. The downhole system of clause 15, wherein an interior maximum pressure differential across the second packer seal from the interior zone to the first exterior zone is the same as an exterior maximum pressure differential across the first packer seal from the first exterior zone to a hydrostatic borehole.

Clause 18. The downhole system of clause 15, wherein an interior maximum pressure differential across the second packer seal from the interior zone to the first exterior zone is less than an exterior maximum pressure differential across the first packer seal from the first exterior zone to a hydrostatic borehole.

Clause 19. A downhole device comprising: a fluid conduit having a longitudinal direction; a first packer positioned on the fluid conduit; a second packer positioned on the fluid conduit in a first longitudinal direction from the first packer; a third packer positioned on the fluid conduit in the first longitudinal direction from the second packer; a fourth packer positioned on the fluid conduit in the first longitudinal direction from the third packer; an interior port from the fluid conduit to an interior zone longitudinally between the second packer and the third packer configured to provide an interior pressurizing fluid to the interior zone; a first exterior port from the fluid conduit to a first exterior zone longitudinally between the first packer and the second packer configured to provide a first exterior pressurizing fluid different from the interior pressurizing fluid to the first exterior zone; and a second exterior port from the fluid conduit to a second exterior zone longitudinally between the third packer and the fourth packer configured to provide a second exterior pressurizing fluid different from the interior pressurizing fluid to the second exterior zone.

Clause 20. The downhole device of clause 19, wherein the first exterior pressurizing fluid and the second exterior pressurizing fluid are the same fluid.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A method of providing fluid pressure in a downhole environment, the method comprising:

expanding a first packer against a borehole wall;

expanding a second packer against the borehole wall;

expanding a third packer against the borehole wall;

expanding a fourth packer against the borehole wall; and pressurizing an interior zone longitudinally between the second packer and the third packer to a first pressure relative to a hydrostatic borehole pressure that is greater than a second pressure of at least one exterior zone, wherein a first exterior zone is longitudinally between the first packer and the second packer and a second exterior zone is longitudinally between the third packer and the fourth packer, wherein expanding the first packer against the borehole wall includes expanding the first packer to a first internal pressure and expanding the second packer against the borehole wall includes expanding the second packer to a second internal pressure different from the first internal pressure, and wherein expanding the third packer against the borehole wall includes expanding the third packer to the second internal pressure and expanding the fourth packer against the borehole wall includes expanding the fourth packer to the first internal pressure.

2. The method of claim 1, further comprising pressurizing the first exterior zone and the second exterior zone to the second pressure, wherein the second pressure is greater than the hydrostatic borehole pressure.

3. The method of claim 1, wherein the first pressure relative to the hydrostatic borehole pressure is greater than a maximum pressure differential between the interior zone and the at least one exterior zone after expanding the second packer and the third packer against the borehole wall.

4. The method of claim 1, wherein the expanding the second packer and the third packer includes creating interior packer seals with an interior maximum pressure differential thereacross, and the first pressure relative to the hydrostatic borehole pressure is greater than the interior maximum pressure differential.

5. The method of claim 1, wherein the second packer and the third packer are expanded to contact the borehole wall before the first packer and the fourth packer.

6. The method of claim 1, wherein the first packer and the fourth packer are expanded to contact the borehole wall before the second packer and the third packer.

7. The method of claim 1, wherein pressurizing the interior zone includes providing a first pressurized fluid to the interior zone that is different from a second pressurized fluid in the at least one exterior zone.

8. The method of claim 7, wherein the first pressurized fluid includes a proppant suspended therein.

9. The method of claim 1, wherein the borehole wall includes a surrounding formation.

10. The method of claim 1, wherein the borehole wall includes a wellbore casing.

11. A method of providing fluid pressure in a downhole environment, the method comprising:

expanding a first packer against a borehole wall;

expanding a second packer against the borehole wall;

expanding a third packer against the borehole wall;

expanding a fourth packer against the borehole wall; and pressurizing an interior zone longitudinally between the second packer and the third packer to a first pressure relative to a hydrostatic borehole pressure that is greater than a second pressure of at least one exterior zone, wherein a first exterior zone is longitudinally between the first packer and the second packer and a second exterior zone is longitudinally between the third packer and the fourth packer, wherein expanding the first packer against the borehole wall includes expanding the first packer to a first contact pressure with the borehole wall and expanding the second packer against the borehole wall includes expanding the second packer to a second contact pressure with the borehole wall different from the first contact pressure, and wherein expanding the third packer against the borehole wall includes expanding the third packer to the second contact pressure with the borehole wall and expanding the fourth packer against the borehole wall includes expanding the fourth packer to the first contact pressure with the borehole wall.

12. The method of claim 11, further comprising pressurizing the first exterior zone and the second exterior zone to the second pressure, wherein the second pressure is greater than the hydrostatic borehole pressure.

13. The method of claim 11, wherein the first pressure relative to the hydrostatic borehole pressure is greater than a maximum pressure differential between the interior zone and the at least one exterior zone after expanding the second packer and the third packer against the borehole wall.

14. The method of claim 11, wherein the expanding the second packer and the third packer includes creating interior packer seals with an interior maximum pressure differential thereacross, and the first pressure relative to the hydrostatic borehole pressure is greater than the interior maximum pressure differential.

15. The method of claim 11, wherein the second packer and the third packer are expanded to contact the borehole wall before the first packer and the fourth packer.

16. The method of claim 11, wherein the first packer and the fourth packer are expanded to contact the borehole wall before the second packer and the third packer.

17. The method of claim 11, wherein pressurizing the interior zone includes providing a first pressurized fluid to the interior zone that is different from a second pressurized fluid in the at least one exterior zone.

18. The method of claim 17, wherein the first pressurized fluid includes a proppant suspended therein.

19. The method of claim 11, wherein the borehole wall includes a surrounding formation.

20. The method of claim 11, wherein the borehole wall includes a wellbore casing.

* * * * *